US009012818B1

(12) United States Patent
Lassota

(10) Patent No.: US 9,012,818 B1
(45) Date of Patent: Apr. 21, 2015

(54) BEVERAGE HEATING ASSEMBLY AND METHOD

(75) Inventor: Zbigniew G. Lassota, Long Grove, IL (US)

(73) Assignee: Food Equipment Technologies Company, Inc., Lake Zurich, IL (US)

( * ) Notice: Subject to any disclaimer, the term of this patent is extended or adjusted under 35 U.S.C. 154(b) by 132 days.

(21) Appl. No.: 13/049,311

(22) Filed: Mar. 16, 2011

Related U.S. Application Data

(60) Provisional application No. 61/315,292, filed on Mar. 18, 2010.

(51) Int. Cl.
*H05B 6/12* (2006.01)

(52) U.S. Cl.
CPC ..... *H05B 6/12* (2013.01)

(58) Field of Classification Search
USPC ..... 219/620–622, 626, 627, 665; 99/451; 340/572.1
See application file for complete search history.

(56) References Cited

U.S. PATENT DOCUMENTS 4,948,499 A * 8/1990 Peranio ..... 210/180
5,954,984 A * 9/1999 Ablah et al. ..... 219/621
2002/0125245 A1* 9/2002 Fuchs ..... 219/622
2008/0173639 A1* 7/2008 Vos ..... 219/621
2009/0065500 A1* 3/2009 England et al. ..... 219/621
2011/0013918 A1* 1/2011 Jeong ..... 399/37

* cited by examiner

*Primary Examiner* — Dana Ross
*Assistant Examiner* — Joseph Iskra
(74) *Attorney, Agent, or Firm* — James W. Potthast; Potthast & Associates

(57) ABSTRACT

A beverage warming assembly (8) with a non-ferromagnetic, transparent heat carafe (10) having an induction heating assembly (38) attached to the bottom (24) by a threaded fastener (46) formed of a generally planer, induction ferromagnetic heating element (42) with a top and a bottom, and an insulating member (44) interposed between the carafe bottom (24) and the bottom of the induction heating element (42) to thermally insulate the bottom (24) from he induction heating element (42), to enable relative movement between the induction heating element (42) and the bottom (24) and to seal a fastener hole (48) against leaks. Different levels of heating are achieved by connecting a high frequency voltage signal from a generator (64) to different inputs along the length of the coil induction coil (40) in response to actuation of heating level selection switches (59, 60, 62). An AC power circuit breaker (70) removes power in response to actuation of a power switch (56) or when an input current detector (72) senses a current level that exceeds a preselected level.

21 Claims, 2 Drawing Sheets

BEVERAGE HEATING ASSEMBLY AND METHOD

CROSS-REFERENCE TO RELATED APPLICATION

This application claims the benefits under 35 U.S.C. 119(e) of U.S. provisional patent application No. 61/315, 292, filed Mar. 18, 2010 entitled "Induction Heated Beverage Dispenser and Method", which is hereby incorporated by reference.

BACKGROUND OF THE INVENTION

1. Field of the Invention

This invention relates generally to beverage warmers like electrical hot plates more particularly to beverage warmers used to maintain beverages within a serving carafe at a preselected elevated temperature.

2. Discussion of the Prior Art

Transparent glass carafes for use with electrical coffee or tea brewers or hot water dispensers are well known. Often the brewer has an underlying hot plate upon which the carafe is supported both during a brew cycle and afterwards. Such hot plates are generally heated by an electrical resistive heating coil. After completion of a brew cycle, carafes filled with freshly brewed beverage are also often moved to a serving location spaced from the coffee maker and kept warm on a separate, free standing, electrical hot plate similar to that associated with the beverage brewer.

Although the glass is relatively fragile compared to other materials, it is commonly used because of its transparency allowing remote, visual determination of contents without the need for electronic level indicators or the like. The glass of such carafe is tempered to withstand the heat without deleterious effects. Clear plastics that are tougher than glass are not used to make such carafes because of their relatively low fusion, melting or deterioration temperatures.

A problem with using such electrically heated hot plates heated by electrical, resistive heating coils is that the heating plates are maintained at a temperature that is hot to the touch and can cause burn injury to human flesh. If the carafe is removed from the hot plate, the hot plate remains hot. In addition, in the case of boiling water with such a hot plate the glass, itself, must become as hot as, or hotter than, the boiling temperature and is thus also hot and potentially dangerous to users. In addition, the power efficiency of heating with electrical resistive heating elements is relatively low due to the loss of heat into the air from the hot plate when the carafe is removed and the heated carafe, itself.

It is known to use relatively higher efficiency induction heaters for food preparation on cooking ranges and the like, but again the food containers must be heated to a temperature above the desired interior temperature of the food in order to cook the food and is thus often maintained at elevated hot temperatures that are dangerous to touch.

In some warmers, the induction heating element is placed inside the beverage container but these other know units also suffer from some disadvantages with respect to selectively changing the degree of heating and prevention of overheating.

Accordingly, the inventor has determined that there is a need to solve some of the safety, efficiency and other problems of known hot water heaters or hot water or beverage warmers and the like.

SUMMARY OF THE INVENTION

It is therefore an object of the present invention to provide a hot beverage dispenser or other container that overcomes the problems of known hot beverage dispensers and warmers.

This objective is achieved in part by providing a beverage warming assembly, with a carafe with a body made of non-ferromagnetic, heat resistant, transparent material with a hollow interior for holding beverage, said body having an open top for receipt of beverage within the interior to be kept warm and a bottom, an induction heating assembly contained within the interior of the body and attached to the bottom, said induction heating assembly including a generally planer, induction heating element with a top and a bottom, and an insulating member interposed between the bottom of the carafe body and the bottom of the induction heating element to thermally insulate the bottom of the carafe body from the induction heating element, and an induction heating base having a housing with a top for supporting the bottom of the carafe body, and an induction module including an induction wave generator for generating electromagnetic waves that pass through the bottom of the carafe to induce electrical eddy currents in the induction heating element that elevate the temperature of the induction heating element above the temperature of the carafe body, said insulating member reducing the passage of heat from the induction heating element through the bottom of the carafe body and a control circuit for controlling the amount of electrical power being applied to the induction wave generator and the temperature to which the induction heating element is elevated.

Preferably the carafe is the carafe is made from one of heat resistant (a) glass and (b) a polymer and the induction heating element is removably fastened to the bottom of the carafe body by a threaded fastener. In the preferred embodiment, the insulating member is made of a food-safe material, such as one of (a) silicon, (b) Viton® Fluroelastomer, (c) Gore Tex® expanded-PTFE and (d) EPDM. The induction heating element is centrally located at the bottom of the carafe and has a generally disc-like shape while the insulating member is at least coextensive with the bottom of the induction heating element.

In the preferred embodiment, the control circuit includes a centrally located induction coil protectively contained within the housing and located adjacent the housing top, and a controller with a current detector for sensing the level of input current to the induction coil and means responsive to the current detector to regulate the amount of input power applied to the induction coil. Switches or the like are provided for manually selecting different levels of heating.

Preferably, the induction wave generator includes an electrical induction coil with a vertical axis of symmetry, and the top of the induction base housing has a recess fitted for snug receipt of the bottom of the carafe, said electrical induction coil being aligned with the induction heating element when the bottom of the carafe is fitted into and supported within the recess. The bottom of the carafe has a downwardly projecting section that is snugly received within the recess.

The objective is also achieved in part by having the insulating member compressed between the induction heating element and the bottom of the carafe to maintain a seal while allowing relative movement between the induction heating element and the bottom of the carafe due to different coefficients of thermal expansion of the induction heating element and the carafe bottom. Also, the induction heating element and insulating member are releasably attached to the bottom of the carafe by means of a threaded fastener that passes through a hole in the bottom of the carafe, and said insulating member provides a water tight seal to prevent leakage through the hole. Thus, the insulating member performs multiple important functions that were lacking in prior warmers.

Achievement of the objective of the invention is also obtained partly by provision of a beverage warming assembly, having a carafe with a body made of non-ferromagnetic, heat resistant, transparent material with a hollow interior for holding beverage, said body having an open top for receipt of beverage within the interior to be kept warm and a glass bottom, a plate-like induction heating element threadably fastened to the bottom of the carafe, and an induction heating base having a housing with a top for supporting the bottom of the carafe body, and an induction module including an induction wave generator including an induction coil for generating electromagnetic waves that pass through the bottom of the carafe to induce electrical eddy currents in the induction heating element that elevate the temperature of the induction heating element above the temperature of the carafe body, and a control circuit a control circuit, including a coil connection switch with an input and a plurality of outputs associated with different levels of heating and connected to corresponding plurality of inputs to the coil at different locations along the coil length, a high frequency electrical wave generator connected to the input of the coil connection switch for generating a high frequency voltage wave, means for manually selecting a plurality of different heating levels associated with the plurality of inputs to the coil, and means responsive the selecting means to control the coil connection switch to pass the high frequency voltage wave to one of the coil inputs associated with a heating level that has been manually selected.

Preferably, the beverage warming assembly also includes an AC power circuit breaker for selectively applying and removing full AC power to the induction heating coil, means for measuring input power to the induction heating coil, means for making a comparison of the input power level as determined by the measuring means with a preselected maximum power level, and means responsive to the comparison to remove power from the coil if the input power level as determined by the measuring means exceeds the preselected maximum power level.

Preferably, the preselecting means includes a plurality of input switches respectively associated with a plurality of different preselected input power settings. In the preferred embodiment the electromagnetic waves are generated at a frequency in the range of 1-kHz to 100-KHz. and the maximum output power of the induction heating coil is approximately one hundred watts to five hundred watts.

Achievement of the objective of the invention is also acquired by providing a method of keeping a beverage warm, by performance of the steps of placing the beverage in a carafe with a body made of non-ferromagnetic, heat resistant, transparent material with a hollow interior for holding the beverage, said body having an open top for receipt of beverage within the interior to be kept warm and a bottom, placing the carafe on top of an induction heating base containing an induction wave generator generating electromagnetic waves with the induction wave generator that pass through the bottom of the carafe to induce electrical eddy currents in an induction heating element attached to the bottom of the carafe, said eddy currents elevating the temperature of the induction heating element above the temperature of the carafe body thermally insulating the induction heating element from the bottom of the carafe to reduce the passage of heat from the induction heating element through the bottom of the carafe body and controlling application of input electrical power to the induction wave generator based on a comparison of an input current with a preselected input current setting.

Preferably, method also includes the step of thermally insulating the induction heating element against direct passage of heat to the bottom of the carafe with an insulating member interposed between the induction heating element and the bottom of the carafe.

BRIEF DESCRIPTION OF THE DRAWINGS

The foregoing objects, features and advantages of the induction heated hot beverage dispenser will be described in detail below with reference to the several figures of the drawing, in which.

DETAILED DESCRIPTION

Figure 1:
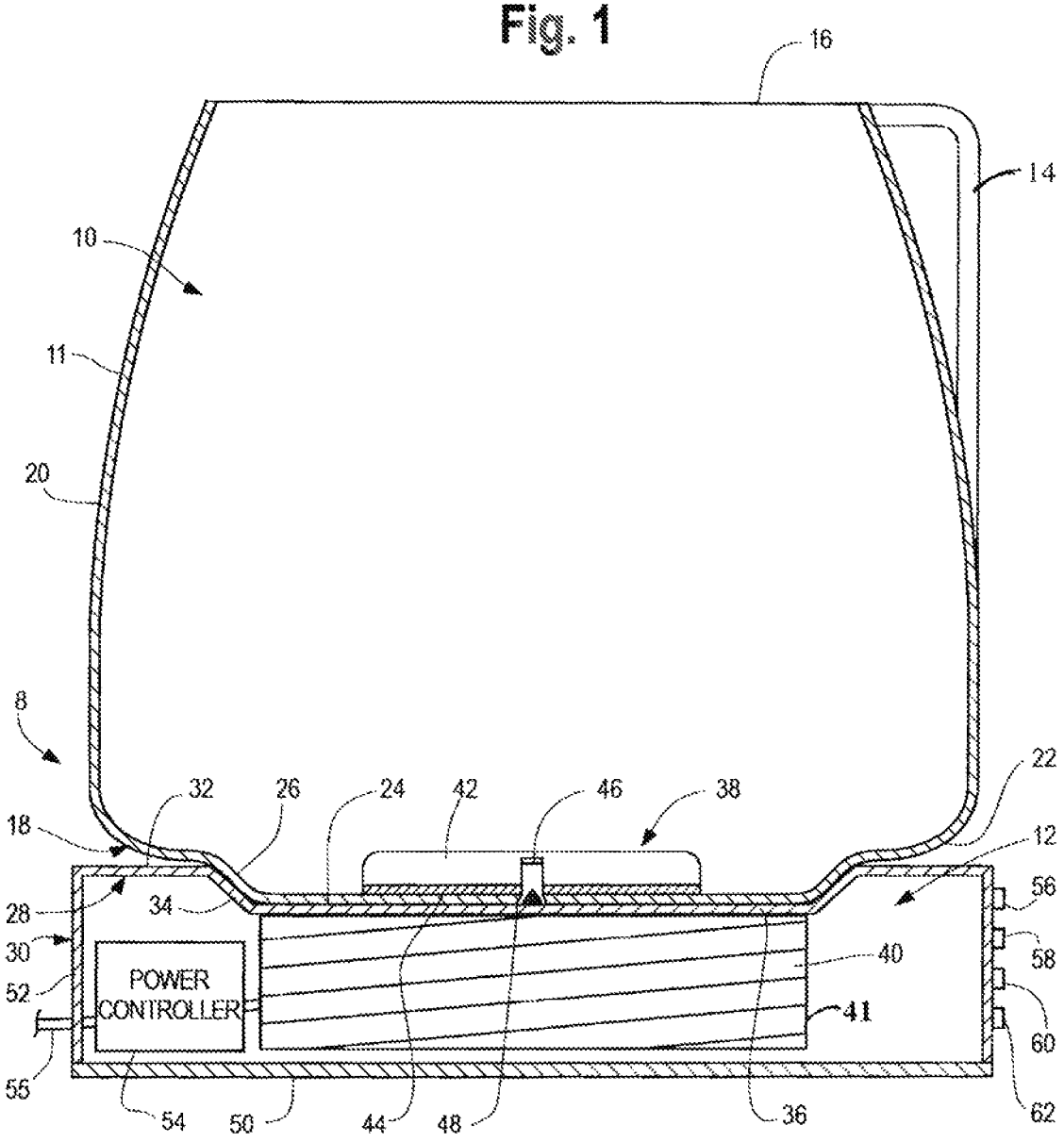
FIG. 1 is a sectional side view of a preferred embodiment of the beverage warming assembly of the present invention.

Referring first to FIG. 1, the preferred embodiment of the beverage warming assembly 8 of the present invention is seen to include a carafe assembly 10 which is removably supported on top of a mating induction heating support base assembly 12. Unlike some known inductively heatable containers which have ferromagnetic bodies and thus become heated themselves, the dispenser 10 has a non-ferromagnetic body 11. Because the body is non-ferromagnetic, it is not affected by the electromagnetic waves generated by the heat inducing support base 12. Accordingly, the dispenser body does not need to be heated to heat or warm the beverage contents.

Preferably, the body of the dispenser 10 is made from an insulating plastic that will remain comfortable to the touch despite elevated temperatures of the beverage contents. Preferably, the insulating plastic is a clear plastic, polypropylene or polysulfone. Alternatively, the dispenser body is a polymeric plastic or glass. The body can also be made from a composite with an inner glass liner and an outer protective polymeric outer shell.

The carafe is shown approximately actual size and is preferably made by a molding process. A separate plastic handle 14 is preferably attached to the side of the body 11. The body has an open top 16 for receipt of beverage joined to a closed bottom 18 by a slightly arcuate wall 20 with a round cross section of varying diameters.

The bottom section 18 has three different sections at different levels. An annular, peripheral rounded shoulder bottom section 22 is joined to a downwardly projecting, central, circular, flat bottom section 24 by a downwardly inwardly extending, annular, truncated conical bottom section 26. These three levels of the bottom section 18 mate with three corresponding top sections of the top 28 of the housing 30 of the base 12. The shoulder 22 mates with a peripheral, annular flat top section 32; the conical bottom section 26 mates with and rests upon a downwardly, inwardly extending conical top section 34, and the central protruding flat central circular bottom section 24 mates with and is supported on top of a depressed, flat, central, top section 36 of approximately equal diameter. Advantageously, this multileveled arrangement enables the bottom 18 of the carafe body 11 to nest within the top 28 to centrally align the central bottom section 24 with the central top section 36 and hinder inadvertent lateral movement of the carafe body 11 while still permitting the carafe bottom 24 to be slid off of the top 28 without the need to first lift the carafe body 11 vertically.

The central alignment of the downward relatively protruding circular bottom section 24 with the relatively depressed central top section 36 also advantageously aligns an induction heating assembly 38 with a central axis of an induction coil 40 that is mounted centrally beneath the interior surface of the circular, central bottom section 26. The induction heating assembly includes a generally planer, disc-like, circular, induction heating element 42 and an insulating member interposed between the interior surface of the central bottom section 24 and a circular, coextensive insulating member 44. The both the insulating member 44 and the induction heating element 42 are releasably attached to the central, circular bottom section 24 by a threaded fastener 46 such as a flat head screw made from non-ferromagnetic material, such as nylon or other food safe plastic. The threaded fastener 46 passes through a mating screw hole 48 extending through the center of the central, circular bottom section 24. The fastener 46 then passes through a central hole in the circular insulating member 44 and is threaded into tapped threaded mating screw hole in the center of the round bottom of the induction heating element 42. When screwed tightly, the fastener 42 squeezes and compresses the insulating member 44 between the bottom surface of the inductive heating element 42 and the interior surface of the central bottom section 24.

Advantageously, the insulating member performs multiple functions. First, it insulates the bottom 18 from direct transfer of heat from the induction heating element 42 to prevent the bottom 18, specifically the bottom section 24 from becoming excessively hot. Secondly, it creates a water proof seal around the threaded fastener and the central screw hole 18 to prevent leakage though the screw hole 48.

Thirdly, the insulating member 44 permits relative movement of the inductive heating element 42 and the bottom section 24 due to different rates of thermal contraction and expansion of the two dissimilar materials from which they are made to reduce potentially damages forces of stress and strain which might otherwise occur. The carafe body 11 including the central bottom section 24 is made from heat resistant glass or a heat resistant polymer, while the induction heating element 42 is preferably made from one of 1810K stainless steel or AISI 304 stainless steel. The insulating member 44 is preferably made from one of silicon, Viton® Fluroelastomer, Gore Tex® expanded-PTFE or (d) EPDM (ethylene-propylene-diene, monomer) rubber.

The top support surface 28 is part of a generally cylindrical housing of the induction heating base 30 with a flat, circular bottom 50 and a cylindrical wall 52 extending between the top support surface 28 and the bottom 50. The housing is preferably made from is water tight and protects the interior from heat and moisture and is preferably made from ABS or PP plastic. An induction wave generator includes the induction coil 40, a power controller 54 and manual selection and control switches 56, 58, 60 and 62. The power controller 54 receives regular 115 VAC household AC power through a power cord 55 and plug (not shown) and generates a relatively higher frequency power signal that is connected to the induction coil 40. The controller also includes a circuit breaker responsive to actuation of switch 52 to remove or apply AC power to the high frequency generator. The power controller 54 also responds to actuation of the switches 58, 60 and 62 to selectively vary the input power signal applied to the coil 40 to selectively vary the degree of warming to be achieved. The three switches 58, 60 and 62 may respectively be associated with low, medium and high heating levels.

Figure 2:
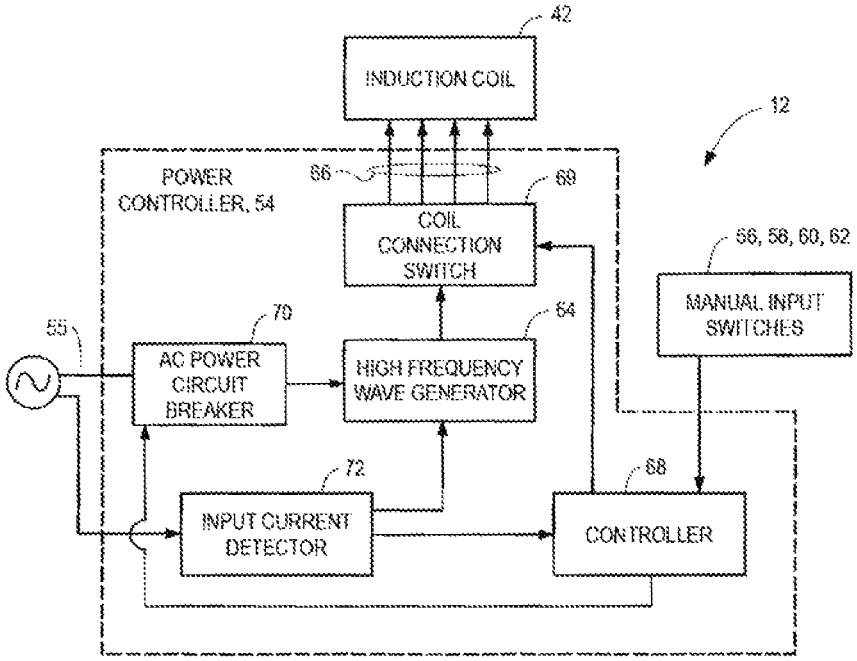
FIG. 2 is functional block diagram of the power controller of FIG. 1.

Referring to FIG. 2, power controller 54 includes a high frequency induction wave generator 64 that produces a high frequency electrical signal that is selectively passed to the induction coil 42 at different inputs 66 of the induction coil 42 associated with different power level settings established by the manual input switches 58, 60 and 62. A controller 68 receives inputs from the manual input switches and depending upon which one is actuated, actuates a coil connection switch 69 to connect the output of the high frequency wave generator to an associated one of the induction coil inputs. The one of the inputs 66 associated with a low heat selection of switch 58 is connected to only one-third of the induction coil; the one of the inputs associated with a medium heat setting of switch 60 is connected to two-thirds of the induction coil and the one of the inputs 66 associated with the high temperature selection of switch 62 connects the high frequency wave generator output across the entire induction coil. The induction coil 42 is thus caused to generate electromagnetic waves for inducing heat in the induction heating element 42 having relatively low, medium and high power levels.

The AC power is applied to the high frequency wave generator 64 through an AC power circuit breaker or power controller 70 and an input current detector 72. It is assumed that the input voltage remains at the customary level normally provided by the utility, such as 110 VAC. If the input current detects an input current to the high frequency wave generator in excess of a preselected safe current level, the controller sends a signal to the AC power circuit breaker 70 to terminate or lower the input power to prevent overheating due to metal being place on the base 12 or an electrical short. Also, when the manual power switch 56 is actuated to an off position, the controller causes circuit breaker to remove AC power from the high frequency wave generator. Power is reapplied when the switch is actuated to the power on position. In lieu of using a discrete coil connection switch, a rheostat may be used for selecting different temperatures by controlling the power level to the high frequency wave generator 64.

The coil 40 preferably is covered with a moisture proof plastic cladding 41 to prevent shorting from accumulated moisture or the like. When excited by the high frequency wave generator 64 the coil 40 produces a high frequency alternating electromagnetic wave which passes through the cladding 41 and though the central top section 36 and the bottom section 24 of the carafe that energizes and heats the induction heating element 42. The frequency of the heat inducing electromagnetic waves is preferably in the range of 1-kHz to 100-kHz with an output power of approximately 100-500 watts to keep the beverage in the carafe assembly 12 at a temperature of approximately 160-180-degrees Fahrenheit. Generally, the higher the frequency of the alternating induced current, the shallower the heating of the part being heated. Frequencies of 100-kHz to 400-kHz produce relatively high-energy heat for quick heating of relatively small parts. On the other hand, deep, penetrating heat may be more effectively obtained at lower frequencies of 5-kHz to 30-kHz. The exact frequencies and power settings must be empirically determined based on the type of beverage being heated, the size of the carafe, the initial temperature of the beverage and the desired temperature at which it is to be maintained,

The invention claimed is:

1. A beverage warming assembly, comprising:

a beverage serving carafe with a vertically elongate body with a hollow interior for holding beverage extending between a closed bottom and an open top and a handle attached to the body to facilitate pouring of beverage from the open top, said body being made of non-ferromagnetic, heat resistant, transparent material;

an induction heating assembly contained within the hollow interior of the body and attached to the bottom, said induction heating assembly including an induction heating element smaller than the bottom of the hollow interior and having a top surface, a side surface and a bottom surface, and a solid insulating member and a fastener releasably attaching the induction heating element to the closed bottom of the of the body with the solid insulating member interposed between the bottom of the carafe body and the bottom surface of the induction heating element to thermally insulate the bottom of the carafe body from the induction heating element and with both the top surface and side surface of the induction heating element fully exposed to the hollow interior for direct contact with, and unfettered heat radiation directly to, any beverage contained within the hollow interior; and an induction heating base having a housing with a top for supporting the bottom of the carafe body, and an induction module including an induction wave generator for generating electromagnetic waves that pass through the bottom of the carafe to induce electrical eddy currents in the induction heating element that elevate the temperature of the top surface and side surface of the induction heating element above the temperature of the carafe body, said insulating member reducing the passage of heat from the induction heating element through the bottom of the carafe body while heat is directly radiated from the top surface and the top surface of the induction heating element, and a control circuit for controlling the amount of electrical power being applied to the induction wave generator and the temperature to which the induction heating element is elevated to maintain the beverage at a preselected elevated temperature suitable for drinking.

2. The beverage warming assembly of claim 1 in which the carafe is made from one of heat resistant (a) transparent glass and (b) transparent polymer, and the induction heating element is removably fastened to the bottom of the carafe body by a threaded fastener.

3. The beverage warming assembly of claim 1 in which the insulating member is made of a food-safe material.

4. The beverage warming assembly of claim 1 in which the induction heating element is less than coextensive with the bottom of the carafe, and centrally located at the bottom of the carafe and has a generally cylindrical shape.

5. The beverage warming assembly of claim 1 in which the induction heating element is less than coextensive with the bottom of the carafe body, and the insulating member is at least coextensive with the bottom of the induction heating element and elevates the bottom surface above the bottom of the body.

6. The beverage warming assembly of claim 1 in which the control circuit includes a centrally located induction coil protectively contained within the housing and located adjacent the housing top, and a controller with means for selectively applying power to different ones of a plurality of inputs of the induction coil in response to actuation of an associated plurality of different temperature selection switches a current detector for sensing the level of input current to a selected one of the plurality of inputs of the induction coil, and means responsive to the current detector to regulate the amount of input power applied to the selected one of the plurality of inputs of the induction coil.

7. The beverage warming assembly of claim 1 in which the induction wave generator includes an electrical induction coil with a vertical axis of symmetry, the top of the induction base housing has a recess fitted for snug receipt of the bottom of the carafe, said electrical induction coil being aligned with the induction heating element when the bottom of the carafe is fitted into and supported within the recess, and the bottom of the carafe has a downwardly projecting section of a width less than another width of the bottom and which conforms to the recess and is snugly received within the recess.

8. The beverage warming assembly of claim 1 in which the insulating member is compressed between the induction heating element and the bottom of the carafe to maintain a seal while allowing relative movement between the induction heating element and the bottom of the carafe due to different coefficients of thermal expansion of the induction heating element and the carafe bottom.

9. The beverage warming assembly of claim 1 in which the induction heating element and insulating member are releasably attached to the bottom of the carafe by means of a threaded fastener that passes through a hole in the bottom of the carafe, and said insulating member provides a water tight seal to prevent leakage through the hole.

10. The beverage warming assembly of claim 9 in which the insulating member is one of (a) a fluroelastomer, (b) an expanded-PTFE and (c) an EPDM.

11. A beverage warming assembly of claim 1 in which the induction heating element has a width and the induction heating coil has a width that is greater than the width of the induction heating element.

12. The beverage warming assembly of claim 1 in which the induction heating element is one (a) 1810K stainless steel; and (b) AISI 304 stainless steel.

13. A beverage warming assembly, comprising:

a carafe with a body made of non-ferromagnetic, heat resistant, transparent material with a hollow interior for holding beverage, said body having an open top for receipt of beverage within the interior to be kept warm and a bottom;

an induction heating element threadably fastened to the bottom of the carafe having both a top surface and a side surface fully exposed to the hollow interior and a bottom surface elevated above the bottom of the body; and an induction heating base having a housing with a top for supporting the bottom of the carafe body, and an induction module including an induction wave generator including an induction coil for generating electromagnetic waves that pass through the bottom of the carafe to induce electrical eddy currents in the induction heating element that elevate the temperature of the fully exposed top surface and side surface of the induction heating element above the temperature of the carafe body, and a control circuit, including a coil connection switch with an input and a plurality of outputs associated with different levels of heating and connected to corresponding plurality of inputs to the coil at different locations along the coil length, a high frequency electrical wave generator connected to the input of the coil connection switch for generating a high frequency voltage wave, means for manually selecting a plurality of different heating levels associated with the plurality of inputs to the coil, and means responsive to the selecting means to control the coil connection switch to pass the high frequency voltage wave to one of the coil inputs associated with a heating level that has been manually selected.

14. The beverage warming assembly of claim 13 including an AC power circuit breaker for selectively applying and removing full AC power to the induction heating coil, means for measuring input power to the induction heating coil, means for making a comparison of the input power level as determined by the measuring means with a preselected maximum power level;

means responsive to the comparison to remove power from the coil if the input power level, as determined by the measuring means, exceeds the preselected maximum power level.

15. The beverage warming assembly of claim 14 in which the power measuring means measures the input current to a high frequency generator.

16. The beverage warming assembly of claim 13 in which the electromagnetic waves are generated at a frequency in the range of 1-kHz to 100-KHz.

17. The beverage warming assembly of claim 14 in which the output power of the induction heating coil is approximately one hundred watts to five hundred watts.

18. A method of keeping a beverage warm, comprising the steps of:

placing the beverage in a beverage serving carafe with a vertical elongate body with a hollow interior for holding beverage extending between a closed bottom and an open top made of non-ferromagnetic, heat resistant, transparent material;

placing the carafe on top of an induction heating base containing an induction wave generator;

removably attaching an induction heating element with a top surface and an a side surface and a bottom surface carrying an underlying insulating member to the bottom of the carafe body with the underlying insulating member interposed between the induction heating element and the bottom of the body to insulate the bottom of body from the bottom surface and to elevate the bottom surface above the bottom of the body;

generating electromagnetic waves with the induction wave generator that pass through the bottom of the carafe and the insulating member to induce electrical eddy currents in the induction heating element removably attached to the bottom of the carafe body, said eddy currents elevating the temperature of the top surface and side surface of the induction heating element above the temperature of the carafe body;

thermally insulating the bottom surface of the induction heating element from the bottom of the carafe with the solid insulating member attached to the bottom of the carafe to reduce the passage of heat from the induction heating element through the bottom of the carafe body; and controlling application of input electrical power to the induction wave generator based on a comparison of an input current with a preselected input current setting to maintain the beverage at a preselected elevated temperature suitable for drinking.

19. The method of claim 18 in which the induction wave generator has an induction coil, the step of controlling includes the steps of selectively applying the input electrical power to the induction coil at a plurality of different inputs of the induction coil associated with different power level settings respectively established by a plurality of different manual input selection switches.

20. The method of claim 18 including the steps of manually holding the carafe with a handle attached to a side of the carafe body to move the carafe to a serving location spaced from the induction wave generator.

21. The beverage warming assembly of claim 1 in which the induction wave generator has an induction coil with a plurality of different inputs associated with different power level settings, and in which the control circuit includes a plurality of manual temperature selection input switches respectively associated with the plurality of different inputs, a controller connected with and responsive to actuation of the manual input switches to selectively connect an electrical power source to different associated ones of the plurality of different inputs.

* * * * *